US007051538B2

(12) United States Patent
Beynon

(10) Patent No.: US 7,051,538 B2
(45) Date of Patent: May 30, 2006

(54) ICE SKATING ARENA

(75) Inventor: Murray Beynon, Toronto (CA)

(73) Assignee: Stadium Consultants International, Inc. (CA)

( * ) Notice: Subject to any disclaimer, the term of this patent is extended or adjusted under 35 U.S.C. 154(b) by 96 days.

(21) Appl. No.: 10/947,378

(22) Filed: Sep. 23, 2004

(65) Prior Publication Data

US 2005/0066677 A1 Mar. 31, 2005

(30) Foreign Application Priority Data

Sep. 26, 2003 (CA) ..... 2443014

(51) Int. Cl.
*A63C 19/10* (2006.01)

(52) U.S. Cl. ..... 62/66; 62/235; 472/92

(58) Field of Classification Search ..... 62/66, 62/235, 347; 165/135; 472/92; 237/69
See application file for complete search history.

(56) References Cited

U.S. PATENT DOCUMENTS

RE29,438 E * 10/1977 MacCracken et al. ..... 165/46
4,357,807 A * 11/1982 Aleksandrow ..... 62/228.2
4,513,583 A * 4/1985 Watt ..... 62/235
5,331,826 A * 7/1994 Stockhaus et al. ..... 62/235
5,771,706 A * 6/1998 Lavigne ..... 62/235
6,230,451 B1 * 5/2001 Stoller ..... 52/169.1

* cited by examiner

*Primary Examiner*—William E Tapolcai
(74) *Attorney, Agent, or Firm*—Manelli Denison & Selter; Edward J. Stemberger

(57) ABSTRACT

An ice hockey arena having an ice rink surrounded by tiers of spectator seats, wherein said ice rink has a playing surface above a first concrete base having a first width and a first length, a first series of cooling pipes within said first base and an insulation layer between said first base and the ground, the improvement comprising a second concrete base having a second width and a second length above said first base wherein said second width is greater than said first width; and a second series of cooling pipes within said second base. The method allows for the enlargement of a standard NHL ice playing surface to International Ice Hockey Federation width playing surface in a cost-effective manner while maintaining acceptable spectator sight lines.

20 Claims, 1 Drawing Sheet

ICE SKATING ARENA

FIELD OF THE INVENTION

This invention relates to ice skating arenas, particularly North American arenas having skating rinks of National Hockey League rink dimensions; to methods of enlargement of said rinks; and resultant enlarged ice rinks made thereby

BACKGROUND TO THE INVENTION

There are two primary sizes of ice surfaces for the playing of ice hockey, optionally within ice skating arenas, namely, 1. the North American National Hockey League (NHL) dimensions of, essentially, 200 ft. length and 85 ft. width; and
2. the International Ice Hockey Federation (IIHF) or Olympic size of 29–30 m. wide by 60–61 m. long (i.e. 95.14–98.42 ft. by 196.85–200.13 ft.).

Thus, the main difference between the two playing surfaces is that the IIHF surface is about 10–14 ft. wider than the NHL surface. The NHL size rink is, generally, used in North America in spectator facilities; while the IIHF size rink is used in Europe.

There are many persons who have begun to question whether or not the NHL-sized ice surfaces existing in facilities should be abandoned in favour of the larger IIHF-sized surfaces because of the increased size and speed of today's hockey players and for other reasons.

However, one major problem associated with the apparently, at first sight, simple task of enlarging an existing NHL playing surface is that it is very difficult, if not impossible, to extend the cooling system which is embedded in the NHL ice surface's concrete slab base and which causes the surface ice to obtain the larger IIHF ice surface. We have conducted extensive research on extending the existing cooling pipes and concrete base by 5–7 feet in width on each side of the ice surface. Advice from leading ice surface manufacturers, skilled in the art, is that the risk level in one approach involving removing the edge of the concrete base without damaging the existing cooling pipes is too high while being probably impossible to accomplish successfully. A second alternative is to pour two new 5–7 feet strips of concrete slab with cooling pipes adjacent to the sides of the existing NHL ice surface. The problem with this solution is that it is anticipated that there will be substandard cooling where the two concrete slabs are adjacent to each other, creating poor ice conditions along two lines running the length of the ice surface, approximately 5–7 feet in from the side boards. The third solution, which would work, is to remove all of the existing NHL ice surface area and enlarge it by replacing it with a new IIHF ice surface area. However, this solution is prohibitive from a capital cost perspective.

A second major problem of enlargement is that the sightlines for the spectators in the tiers of seats adjacent the ice rink playing surface to view the ice surface are designed for the smaller NHL size. When the surface is made larger, i.e. to the IIHF size, almost all of the spectators on the sides of the ice are not able to see a significant area of the ice surface that is closest to them. Therefore, the solution of simply replacing the NHL-sized ice surface with an IIHF-sized surface is unacceptable because of the sub-standard sightlines for spectators sitting on the sides of the ice surface, particularly when many are VIP customers. An alternative solution that we investigated was to change the angle or placement of the seating tiers to achieve acceptable sightlines. This, however, would be prohibitively expensive, requiring the demolition of almost the total interior bowl of the arena on the sides of the ice surface.

For the above reasons, although there is a long felt want to effect the width enlargement of the playing surface, to-date, no spectator arena has had its ice surface converted from NHL size to IIHF size, without first removing the NHL size ice surface.

There is, therefore, a need for a practical and cost-effective method of converting an ice hockey rink from NHL dimensions to IIHF dimensions.

SUMMARY OF THE INVENTION

It is an object of the present invention to provide a method of enlarging an existing ice hockey rink playing surface in a practical and cost-effective manner.

It is a further object to provide an enlarged ice hockey rink playing surface when made by said process.

One aspect of the present invention is to pour a new, larger IIHF-size concrete base with new cooling pipes in the base on top of the existing NHL concrete floor. Below this new base and the existing base, the existing heating system, which is present to prevent permafrost, is left in place. In a very few arenas, where there is no functioning heating system in place, a new heating system can be made available in the existing slab by using the old cooling pipes, or a new heating system installed immediately on top of the existing slab. In either case, preferably, approximately about 10 cm of insulation is then required between the two concrete slabs.

Therefore, the new "cooling" slab of approximately 15 cm thickness will be approximately 15 cm–25 cm above the old surface. Because it is higher, the spectators' sightlines of the ice surface are maintained or improved.

An additional preferred aspect of the invention is to super-elevate the new slab by having over 10 cm of material, such as insulation and/or sand and/or lightweight concrete or the like, between the new upper concrete base and the existing lower concrete base. This will raise or elevate the upper base, and, thus, improve the sightlines for spectators to an acceptable standard.

Accordingly, the invention provides an ice hockey arena having an ice rink surrounded by tiers of spectator seats, wherein said ice rink has a playing surface above a first concrete base having a first width and a first length and, a first series of cooling pipes within said first base, the improvement comprising (i) a second concrete base having a second width and a second length above said first base wherein said second width is greater than said first width; and (ii) a second series of cooling pipes within said second base.

There may be an insulation layer between said first base and the ground.

Preferably, the first concrete base has heating means within or below the insulation layer.

In preferred embodiments, the first series of cooling pipes within the first base are adapted to constitute heating pipes which receive heating fluid.

Preferably, there is an infill layer between the first base and the second base of a thickness selected from 2–20 cm; preferably selected from 6–14 cm, which infill layer material may comprise, for example, insulation material, sand, lightweight concrete or the like.

The rink may further comprise heating means, immediately below the second base, or preferably within or below the infill layer.

The second base may be of any suitable thickness, preferably of a thickness selected from 10–20 cm.

In a further aspect, the invention provides a method of making an enlarged ice rink surrounds by tiers of spectator seats, as hereinabove defined, wherein said ice rink has a playing surface above a first concrete base having a first width and a first length, a first series of cooling pipes within said first base and an insulation layer between said first base and the ground; said method comprising (a) forming a second concrete base above said first base, said second base having a second width and a second length, wherein said second width is greater than said first width; and (b) providing said second base with a second series of cooling pipes.

The method in one embodiment provides adapting the first series of cooling pipes to constitute heating pipes by adapting them to receive heating fluid.

Preferably, the invention further involves providing an infill layer between the first and second bases, formed, for example, of insulation material, sand or concrete, of a thickness selected, for example, from 2 cm–30 cm, preferably 10 cm–30 cm.

The method, further preferably, provides installation of heating means within or below the infill layer.

Most advantageously, the method in preferred embodiments, provides forming the second base having a thickness selected from 10 cm–20 cm.

BRIEF DESCRIPTION OF THE DRAWINGS

In order that the invention may be better understood, preferred embodiments will now be described, by way of example only, wherein.

DETAILED DESCRIPTION OF PREFERRED EMBODIMENTS

Figure 1:
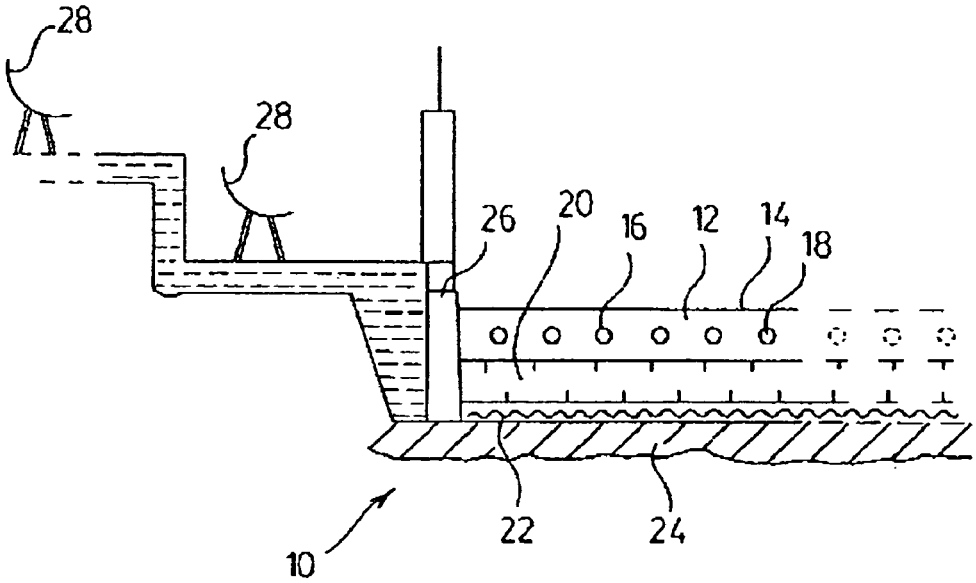
FIG.1 (PRIOR ART)
FIG. 1 is a diagrammatic width cross-section of a NHL ice rink, in part, according to the prior art.

With reference to FIG. 1 this shows generally as 10, part of a width section of a NHL rink having a concrete base 12 with an ice playing surface 14 and a series of cooling pipes 16 through which pass a cooling fluid 18 from refrigeration means (not shown). Beneath base 12 is an insulation layer 20 above an electric heating system 22 laid out on the surface of ground 24. Adjacent side 26 of rink 10 are tiers of spectator seats 28.

Rink 10 is of standard NHL width of approximately 85 ft, and length dimensions.

Figure 2:
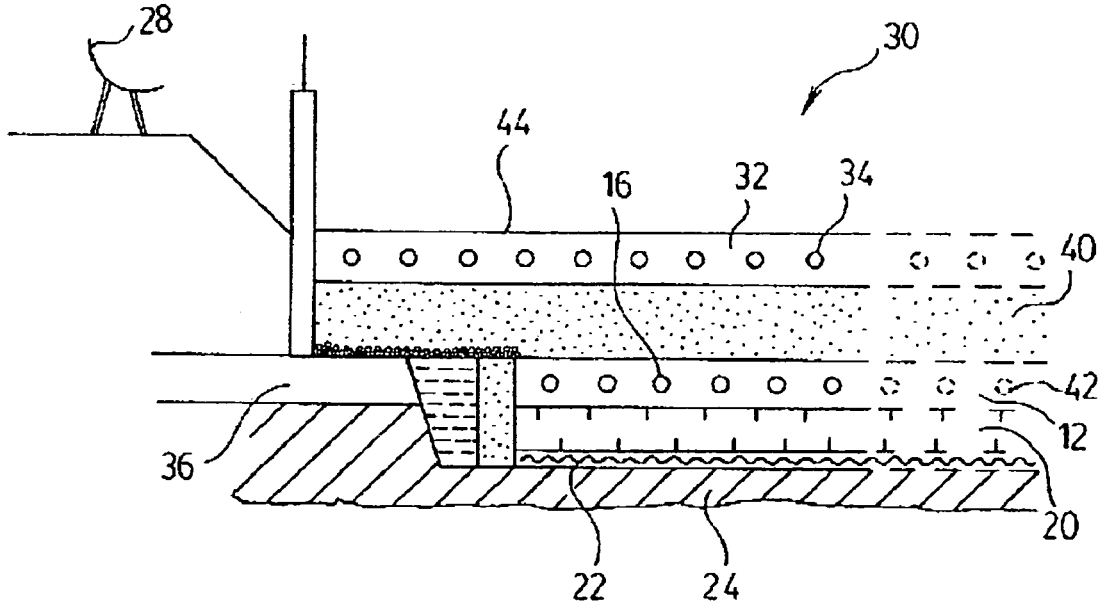
FIG. 2 is a diagrammatic width cross-section of an enlarged NHL rink, in part, according to the invention; and wherein the same numerals denote like parts.

With reference now to FIG. 2, this shows, generally, as 30, NHL rink 10 of FIG. 1 having enlarged ice surface rink of IIHF width having a new concrete base 32 with its own series of cooling pipes 34. Base 32 is of a standard IIHF width of about 29–30 m. Thus, base 32 extends widthwise about 1.8 m beyond each side of base 12. Below this overlap, a new concrete base 36 is poured and above which is laid out new heating conduit 38. Between base 32 and base 12 is an infill layer 40 cm of sand which acts as an insulation layer and to elevate base 32. In the embodiment shown, pipes 16 have been adapted to received heated fluid 42 from heating means (not shown). Base 32 has ice playing surface 44.

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated

The invention claimed is:

1. An ice hockey arena having an ice rink surrounded by tiers of spectator seats, wherein said ice rink has a playing surface above a first concrete base having a first width and a first length; and a first series of cooling pipes within said first base, the improvement comprising (i) a second concrete base having a second width and a second length above said first base wherein said second width is greater than said first width; and (ii) a second series of cooling pipes within said second base.

2. An arena as defined in claim 1 further comprising an insulation layer between said first base and the ground.

3. An arena as defined in claim 2 further comprising heating means within or below said insulation layer.

4. An arena as defined in claim 1, wherein said first series of cooling pipes constitute heating pipes adapted to receive heating fluid.

5. An arena as defined in claim 2, wherein said first series of cooling pipes constitute heating pipes adapted to receive heating fluid.

6. An arena as defined in claim 3, wherein said first series of cooling pipes constitute heating pipes adapted to receive heating fluid.

7. An arena as defined in claim 1 further comprising an infill layer between said first base and said second base.

8. An arena as claimed in claim 1 further comprising heating means within or below said infill layer below said second base.

9. An arena as claimed in claim 7 wherein said infill layer has a thickness selected from 2 cm to 40 cm.

10. An arena as claimed in claim 9 wherein said infill layer has a thickness selected from 6 cm to 14 cm.

11. An arena as claimed in claim 1 wherein said second slab has a thickness selected from 10 cm–20 cm.

12. An arena as claimed in claim 7 wherein said infill layer comprises material selected from insulation, sand, lightweight concrete and like material.

13. A method of enlarging an ice rink surrounded by tiers of spectator seats, wherein said ice rink has a playing surface above a first concrete base having a first width and a first length, a first series of cooling pipes within said first base and an insulation layer between said first base and the ground; said method comprising (c) forming a second concrete base above said first base, said second base having a second width and a second length, wherein said second width is greater than said first width; and (d) providing said second base with a second series of cooling pipes.

14. A method as defined in claim 13 further comprising adapting said first series of cooling pipes to constitute heating pipes adapted to receive heating fluid.

15. A method as defined in claim 13 further comprising providing an infill layer between said first base and said second base.

16. A method as defined in claim 15, wherein said infill layer is formed of a material selected from insulation, sand, lightweight concrete and like material.

17. A method as defined in claim 13 further comprising providing heating means below said second base and above said first base.

18. A method as defined in claim 15 further comprising providing heating means within or below said infill layer.

19. A method as defined in claim 15 comprising providing said infill layer of a thickness selected from 2 cm–20 cm.

20. A method as defined in claim 13 comprising providing said second base of a thickness selected from 10 cm–20 cm.

* * * * *